United States Patent [19]

Takahashi et al.

[11] 4,441,936

[45] Apr. 10, 1984

[54] HIGH-STRENGTH, LOW-YIELD-POINT, COLD-ROLLED STEEL SHEET OR STRIP SUITABLE FOR DEEP DRAWING

[75] Inventors: Nobuyuki Takahashi; Masaaki Shibata; Yoshikuni Furuno, all of Kitakyusyushi, Japan

[73] Assignee: Nippon Steel Corporation, Tokyo, Japan

[21] Appl. No.: 442,780

[22] Filed: Nov. 18, 1982

Related U.S. Application Data

[63] Continuation of Ser. No. 249,456, Mar. 31, 1981, abandoned.

[30] Foreign Application Priority Data

Apr. 9, 1980 [JP] Japan ..... 55-46473

[51] Int. Cl.[3] ..... C21D 8/04; C21D 9/48

[52] U.S. Cl. ..... 148/12 C; 148/36

[58] Field of Search ..... 148/12 C, 12 D, 36, 148/12 F

[56] References Cited

U.S. PATENT DOCUMENTS

| | | | |
|---|---|---|---|
| 3,368,886 | 2/1968 | Muta et al. | 148/12 C |
| 3,607,456 | 9/1971 | Forand, Jr. | 148/12 C |
| 3,827,924 | 8/1974 | Takechi et al. | 148/36 |
| 3,897,280 | 7/1975 | Gondo et al. | 148/12 C |
| 3,926,692 | 12/1975 | Ludwigson | 148/36 |
| 3,988,173 | 10/1976 | Kawano | 148/12 C |
| 4,219,371 | 8/1980 | Nakasugi et al. | 148/12.3 |
| 4,314,862 | 2/1982 | Sudo et al. | 148/12 F |
| 4,397,699 | 8/1983 | Takahashi et al. | 148/12 C |

FOREIGN PATENT DOCUMENTS

| | | | |
|---|---|---|---|
| 54-104417 | 8/1979 | Japan | 148/12 C |
| 55-24952 | 2/1980 | Japan | 148/12 C |

*Primary Examiner*—Peter K. Skiff

*Attorney, Agent, or Firm*—Wenderoth, Lind & Ponack

[57] ABSTRACT

A high-strength, deep-drawing, cold-rolled steel sheet or strip consisting essentially of not more than 0.020% C, not more than 0.8% Si, not more than 1.5% Mn, 0.03 to 0.14% P, not more than 0.20% sol.Al, not more than 0.008% N, Ti in an amount 4 to 20 times that of (C+N), and not more than 0.0080% B, with the balance being iron and unavoidable impurities.

5 Claims, No Drawings

HIGH-STRENGTH, LOW-YIELD-POINT, COLD-ROLLED STEEL SHEET OR STRIP SUITABLE FOR DEEP DRAWING

CROSS-REFERENCE TO RELATED APPLICATION

This is a continuation application of Ser. No. 249,456, filed Mar. 31, 1981, now abandoned.

BACKGROUND OF THE INVENTION

1. Field of the Invention

The present invention relates to high-strength, low-yield-point, cold-rolled steel sheet or strip (hereinafter referred to simply as "sheet") having excellent deep drawing property.

2. Description of the Prior Art

In recent years, demand has been rising for high-strength, cold-rolled steel sheet, particularly for automobile car bodies since such sheet is effective in reducing the car body weight and therefore contributes to fuel economy and driver safety. In the automobile industry, high-strength, cold-rolled steel sheet has been used not only for interior parts of car bodies but also for such exterior parts as hoods, trunks and fenders. Because of this, such sheet must above all have both good shape fixability after press forming, and not only a high tensile strength but also a low yield point, namely a low yield ratio (about 0.6 or less). In addition, the sheet is also required to have a high Lankford value ($\bar{r}$) of not lower than about 1.6, a property that is required so as to preclude the pronounced appearance of surface defects, such as surface wrinkles.

Among high-strength, cold rolled steel sheets which have been developed up to now, the desired strength is obtained in some by utilizing solid solution hardening induced by carbon, manganese, phosporous, etc. and in others by utilizing the precipitation hardening induced by fine precipitates, such as TiC and NbC. Still others which have been more recently developed rely upon a dual phase structure of ferrite and martensite. However, none of the recently developed high-strength, cold rolled steel sheets can simultaneously satisfy the need for both a low yield ratio and a high $\bar{r}$ value. In all cases, one or the other of these requirements is not met. By way of example, there can be mentioned the high-strength, cold-rolled steel sheets disclosed in Japanese Patent Publication No. 31090/1975 and Japanese Publicly Disclosed Patent application No. 24952/1980. The former is a high-yield-point, high-strength, cold-rolled sheet with a high yield point that makes it inappropriate for use in applications where press forming is required. The latter is indeed a high-strength steel, but one which is highly susceptible to secondary work cracking.

SUMMARY OF THE INVENTION

Therefore, one of the objects of the present invention is to provide a high-strength, cold-rolled steel sheet which has both a low yield ratio (0.6 or less) and a high Lankford value ($\bar{r}$) (1.6 or higher) and which is also superior in secondary workability.

Another object of the present invention is to provide a high-strength, cold-rolled steel sheet which has the high $\bar{r}$ value of an extremely low-carbon, titanium-stabilized steel, is conferred high strength by the addition of phosphorous, and is enhanced in secondary workability by the addition of boron.

Although phosphorus is the cheapest element for use in increasing the strength of steels, it has a critical disadvantage in that it tends to cause embrittlement cracking in steel sheets exposed to heavy load after deep drawing. That is to say, it causes secondary work cracking. Particularly, when the carbon content in the steel is very low, this secondary work cracking occurs very easily even under a very slight load. Therefore, up to now, it has been regarded to be practically impossible to produce a high strength steel sheet on a commercial basis by adding phosphorus to a very low carbon steel.

The present inventors have conducted extensive studies and experiments for improving the secondary workability of super-low carbon, Ti-containing steels with addition of phosphorus. Through their work they found that secondary workability can be remarkably improved by addition of boron.

The high-strength, cold-rolled sheet having low yield ratio and excellent deep drawability according to the present invention contains (in weight percent), C: not more than 0.020L%
Si: not more than 0.8%
Mn: not more than 1.5% P: 0.03 to 0.14%
Sol.Al: not more than 0.20%
N: not more than 0.008%
Ti/(C+N): 4 to 20
B: not more than 0.0080%
Either or both of Mo and Cr: not more than 1.0%.

DETAILED DESCRIPTION OF THE INVENTION

The present invention will be described in detail below.

A carbon content of over 0.020% increases formation of TiC, thus lowering the deep drawability, and raises the recrystallization temperature, thus making it necessary to use higher annealing temperatures. Therefore, the upper limit of the carbon content in the present invention is set at 0.020%, with the preferable carbon content being not more than 0.010%.

Silicon is effective for improving the strength of the steel, but a silicon content exceeding 0.8% will deteriorate the paintability of the resultant steel sheet and thus should be avoided. A silicon content of not more than 0.6% is preferable.

Manganese is also effective for improving the strength, but when added in an amount of more than 1.5%, it will deteriorate the deep drawability, and will hinder the vacuum degassing treatment of the steel because it lowers the temperature of the molten steel through endothermic reaction. The preferable manganese content is not more than 1.0%.

Phosphorous is important for increasing the strength of the steel according to the present invention. However, less than 0.03% phosphorus will not produce the desired improvement of strength, and on the other hand, more than 0.14% phosphorus will cause formation of TiP in a substantial amount due to reaction between the phosphorus and the titanium in the steel, thus lowering the deep drawability. Moreover, the weldability of the resultant steel sheet will also be degraded. The preferable range of phosphorus content in the present invention is from 0.04 to 0.01%.

Aluminum is necessary for avoiding the occurrence of surface defects in the steel sheet because of the formation of $TiO_2$. However, an excessive aluminum content will cause the problem of surface defects due to $Al_2O_3$. Therefore, the sol.Al content is limited to 0.20% max. Preferably the aluminum content should be 0.10% or less.

The nitrogen content should be 0.008% or less. Otherwise it degrades the deep drawability.

Titanium easily reacts with carbon, nitrogen, oxygen and sulpher. However, if the carbon content is restricted as above, oxygen is removed by aluminum and the nitrogen and sulphur contents are such as usually contained in steel produced by modern methods ($N<0.008\%$, $S<0.030\%$), it is under such circumstances necessary to add titanium in an amount at least four times that of the total carbon and nitrogen content in order to maintain the desired deep drawability.

However, a titanium content exceeding 20 times the total content of carbon and nitrogen produces no special advantages, and only increases the production cost. The preferable range of $$\frac{Ti}{(C+N)}$$

is from 6 to 15.

Boron is the most important element in the present invention, and essential for improving secondary workability. However, an excessive boron content will cause cracking in the steel slab, and the upper limit of boron is set at 0.0080%.

In order to obtain further improvement of strength while the other desired effects of the present invention are maintained, molybdenum and/or chromium may be added in an amount not more than 1.0% The upper limit of these elements is set at 1.0% in order to avoid the deterioration of the deep drawability caused by excessive addition of these elements.

The steel composition as above defined may be prepared in a converter or an electric furnace, and subjected to vacuum degassing treatment, and then breaking down or continuous casting to obtain steel slabs.

It is preferable that the addition of titanium be made after deoxidation by aluminum in the vacuum degassing treatment. The steel slab is cooled, and hot rolled, or the hot steel slab may be directly hot rolled without cooling.

For soaking the steel slab, a soaking temperature not lower than 1100° C. is preferable for maintaining the desired finishing temperature, which is desirably maintained at the $Ar_3$ point or higher for the purpose of improving the deep drawability. The coiling temperature is maintained at 700° C. or lower, preferably 650° C. or lower.

If the coiling temperature exceeds 700° C., a large amount of TiP is produced due to the so-called self-annealing effect of the hot rolled coil, and the deep drawability is deteriorated. Therefore, an excessively high coiling temperature should be avoided.

The hot rolled coil is then acid-pickled and cold rolled. In order to maintain the desired deep drawability as much as possible and promote recrystallization at lower temperature and for a shorter time, it is preferable that the cold rolling reduction rate is 70% or higher. Subsequent to the cold rolling, the cold rolled strip is annealed at temperatures hot higher than the $Ar_3$ point. For the annealing, either the batch method or the continuous method will do, but from the viewpoint of improvement of the secondary workability, continuous annealing is preferable.

After the annealing, the strip is subjected to temper rolling, if necessary, to obtain final products.

The present invention can be applied not only to a high-strength, cold rolled steel sheet, but also to production of substrates for high-strength, surface-treated steel sheets having a low yield ratio and excellent deep drawability to be coated with zinc, tin, aluminum, chromium, tin-lead alloy, etc.

DESCRIPTION OF PREFERRED EMBODIMENTS

A steel having the chemical composition as shown in Table 1 was hot rolled into a hot rolled strip coil under the hot rolling conditions also shown in Table 1, then acid-pickled, and cold rolled at an 80% reduction rate into a cold rolled strip coil 0.9 mm in thickness. Then the strip was subjected to batch-type annealing at 750° C. for four hours or to continuous recrystallization annealing at 800° C. for one minute. Subsequently, temper rolling was carried out at a reduction rate of 0.5%.

The mechanical properties and secondary workability of the resultant products are shown in Table 2. For evaluation of the secondary workability, disc blanks were taken from the strip and subjected to primary drawing at different drawing ratios using three-step cylindrical drawing. Then each drawn workpiece was cooled to 0° C. and a load was applied to the cup portion. The secondary workability was evaluated by whether embrittlement cracking occurred in the side wall portion of the cup when the load was applied.

As shown in Table 2, the steel according to the present invention shows a yield ratio not higher than 0.6 and an $\bar{r}$ value not lower than 1.6, as well as remarkably improved secondary workability. Therefore, the steel strip or sheet according to the present invention has a remarkable industrial advantage in that it is excellent in shape fixability in spite of its high strength, is free from secondary working cracking, and is very easy to deep draw. It is also greatly advantageous that the present steel can be produced satisfactorily using batch-type annealing, but further improved qualities can be obtained by continuous annealing at lower production cost.

TABLE 1

| | Specimen No. | Chemical Composition (weight %) | | | | | | | | | | | Hot Rolling Temperature (°C.) | |
|---|---|---|---|---|---|---|---|---|---|---|---|---|---|---|
| | | C | Si | Mn | P | S | Sol.Al | N | Ti | Ti/(C + N) | B | Other elements | Finishing Temp. | Coiling Temp. |
| Inventive Steel | A | 0.011 | 0.03 | 0.41 | 0.062 | 0.012 | 0.046 | 0.0034 | 0.076 | 5.3 | 0.0009 | — | 900 | 600 |
| | B | 0.005 | 0.20 | 0.60 | 0.100 | 0.011 | 0.044 | 0.0040 | 0.100 | 11.1 | 0.0058 | — | 910 | 625 |
| | C | 0.008 | 0.24 | 0.94 | 0.096 | 0.013 | 0.057 | 0.0043 | 0.083 | 6.8 | 0.0030 | Cr 0.50 | 905 | 600 |
| | D | 0.007 | 0.42 | 0.99 | 0.098 | 0.012 | 0.055 | 0.0046 | 0.090 | 7.8 | 0.0034 | Cr 0.40 Mo 0.30 | 910 | 600 |
| Comparative | E | 0.006 | 0.02 | 0.72 | 0.067 | 0.012 | 0.042 | 0.0032 | 0.081 | 9.0 | — | — | 910 | 595 |
| | F | 0.006 | 0.03 | 0.63 | 0.097 | 0.012 | 0.045 | 0.0043 | 0.095 | 9.2 | — | — | 900 | 610 |

TABLE 1-continued

| | Specimen No. | Chemical Composition (weight %) C | Si | Mn | P | S | Sol.Al | N | Ti | Ti/(C + N) | B | Other elements | Hot Rolling Temperature (°C.) Finishing Temp. | Coiling Temp. |
|---|---|---|---|---|---|---|---|---|---|---|---|---|---|---|
| Steel | G | 0.009 | 0.03 | 0.75 | 0.115 | 0.013 | 0.036 | 0.0045 | 0.120 | 8.9 | 0.0030 | — | 910 | 750 |

TABLE 2

| | Specimen No. | Type of Annealing | Mechanical Properties: Yield Point (Kg/mm²) | Tensile Strength (Kg/mm²) | Elongation (%) | $\bar{r}$ Value | Yield Ratio | Evaluation of* Secondary Workability Drawing Ratio 2.6 | 2.9 | 3.2 | 3.6 |
|---|---|---|---|---|---|---|---|---|---|---|---|
| Inventive Steel | A | Batch-Type | 22.7 | 40.7 | 43 | 1.89 | 0.56 | o o | o o | o o | o x |
| | | | | | | | | o o | o o | o o | o x |
| | | Continuous-Type | 23.3 | 41.4 | 44 | 1.84 | 0.54 | o o | o o | o o | o o |
| | | | | | | | | o o | o o | o o | o o |
| | B | Batch-Type | 23.4 | 44.2 | 40 | 1.76 | 0.53 | o o | o o | o o | o x |
| | | | | | | | | o o | o o | o o | x x |
| | | Continuous-Type | 24.0 | 44.8 | 41 | 1.73 | 0.54 | o o | o o | o o | o o |
| | | | | | | | | o o | o o | o o | o o |
| | C | Continuous-Type | 24.2 | 46.6 | 38 | 1.68 | 0.52 | o o | o o | o o | o o |
| | | | | | | | | o o | o o | o o | o x |
| | D | Continuous-Type | 26.1 | 50.4 | 36 | 1.60 | 0.52 | o o | o o | o o | o o |
| | | | | | | | | o o | o o | o o | o x |
| Comparative Steel | E | Batch-Type | 18.9 | 37.9 | 44 | 1.95 | 0.50 | o o | x x | x x | x x |
| | | | | | | | | o o | x x | x x | x x |
| | | Continuous-Type | 19.0 | 38.1 | 45 | 1.93 | 0.50 | o o | o x | x x | x x |
| | | | | | | | | o o | o x | x x | x x |
| | F | Batch-Type | 21.2 | 40.2 | 40 | 1.82 | 0.53 | x x | x x | x x | x x |
| | | | | | | | | x x | x x | x x | x x |
| | | Continuous-Type | 21.8 | 40.8 | 42 | 1.80 | 0.53 | o x | x x | x x | x x |
| | | | | | | | | o o | x x | x x | x x |
| | G | Continuous-Type | 23.2 | 45.7 | 38 | 1.54 | 0.51 | o o | o o | o o | o o |
| | | | | | | | | o o | o o | o o | o x |

*o: no embrittlement crack
x: embrittlement crack

What is claimed is:

1. A method for the manufacture of a high-strength cold rolled steel sheet having a yield point of not more than 26.1 kg/mm², a yield ratio of not more than 0.6, and an $\bar{r}$ value of not less than 1.6 and excelling in secondary workability, which comprises heating to a temperature of not less than 1100° C. a steel slab consisting of not more than 0.01% C, not more than 0.60% Si, not more than 1.5% Mn, 0.03 to 0.14% P, not more than 0.20sol. Al, not more than 0.008% N, Ti in an amount 4 to 20 times the combined amount of C+N and not more than 0.100%, 0.009 to 0.0080% B, with the balance being iron and unavoidable impurities, then hot rolling the heated steel slab at a finishing temperature of not less than the $Ar_3$ point and coiling the hot rolled steel strip at a temperature of not more than 650° C., subsequently cold rolling the resultant hot rolled steel sheet at a reduction rate of not less than 70%, and annealing the cold rolled sheet at a temperature of not more than the $Ar_3$ point.

2. Method according to claim 1, which further contains at least one of Mo and Cr, in an amount not more than 1.0%.

3. A method according to claim 1 in which the maximum silicon content is 0.42%.

4. A method according t claim 1 in which the annealing treatment is conducted by continuous annealing.

5. A high-strength cold rolled steel sheet produced according to the method of claim 1 having a low yield ratio and a high degree of secondary workability.

* * * * *